US009281137B2

(12) United States Patent
Arihara et al.

(10) Patent No.: US 9,281,137 B2
(45) Date of Patent: Mar. 8, 2016

(54) SWITCH

(75) Inventors: Takeshi Arihara, Kyoto (JP); Masaru Morimoto, Kyoto (JP); Tomoyuki Washizu, Kyoto (JP); Yutaka Okayasu, Kyoto (JP)

(73) Assignee: OMRON Corporation, Kyoto (JP)

( * ) Notice: Subject to any disclaimer, the term of this patent is extended or adjusted under 35 U.S.C. 154(b) by 134 days.

(21) Appl. No.: 14/342,716

(22) PCT Filed: Mar. 15, 2012

(86) PCT No.: PCT/JP2012/056653

§ 371 (c)(1),
(2), (4) Date: Aug. 13, 2014

(87) PCT Pub. No.: WO2013/038738

PCT Pub. Date: Mar. 21, 2013

(65) Prior Publication Data

US 2015/0021150 A1 Jan. 22, 2015

(30) Foreign Application Priority Data

Sep. 15, 2011 (JP) ..... 2011-201659

(51) Int. Cl.
*H01H 1/36* (2006.01)
*H01H 1/44* (2006.01)
(Continued)

(52) U.S. Cl.
CPC . *H01H 1/36* (2013.01); *H01H 1/44* (2013.01); *H01H 3/04* (2013.01); *H01H 9/02* (2013.01);
(Continued)

(58) Field of Classification Search
CPC ..... H01H 1/18; H01H 1/20; H01H 1/26; H01H 2221/088; H01H 3/42; H01H 21/12; H01H 2221/036; H01H 3/40; H01H 1/40; H01H 1/44; H01H 21/24; H01H 2203/036; H01H 1/36; H01H 3/04; H01H 9/02; H01H 21/28; H01H 19/14; H01H 1/242; H01H 3/38; H01H 2235/01; H01H 21/14; H01H 21/36; H01H 2205/002; H01H 3/50; H01H 21/50; H01H 2229/014; H01H 2221/044; H01H 21/30
USPC ..... 200/252, 16 R–16 D, 520, 530–536, 553, 200/557–559, 561–563, 276.1, 61.82, 8 R, 200/17 R, 260, 11 R, 335
See application file for complete search history.

(56) References Cited

U.S. PATENT DOCUMENTS 6,768,069 B1 * 7/2004 Su ..... H01H 1/242 200/276.1
6,917,008 B1 * 7/2005 Ni ..... H01H 21/282 200/16 C (Continued)

FOREIGN PATENT DOCUMENTS

| | | | |
|---|---|---|---|
| JP | 47-5735 | Y1 | 2/1972 |
| JP | 54-22176 | U | 2/1979 |
| JP | 55-53824 | U | 4/1980 |
| JP | 08-055538 | A | 2/1996 |

(Continued)

OTHER PUBLICATIONS

International Search Report for corresponding International Application No. PCT/JP2012/056653, mailed Jun. 12, 2012 (4 pages).

*Primary Examiner* — Edwin A. Leon
(74) *Attorney, Agent, or Firm* — Osha Liang LLP

(57) ABSTRACT

A switch has a base having a frame portion disposed integrally with an outer peripheral portion of an upper surface of the base, a common fixed contact disposed at a corner of inside surfaces of the frame portion, and a fixed contact disposed on an inside surface of the base opposite to the common fixed contact, a spring member having elastic arm portions extending respectively from both ends of a bellows-like spring portion, wherein a free end portion of one of the elastic arm portions serves as a sliding movable contact, wherein a free end portion of another of the elastic arm portions serves as a rotationally movable contact, and wherein the rotationally movable contact is positioned so as to be in contact with the common fixed contact of the base, and an operation lever including an operation rib.

13 Claims, 6 Drawing Sheets

(51) Int. Cl.

| | |
|---|---|
| ***H01H 21/24*** | (2006.01) |
| ***H01H 3/04*** | (2006.01) |
| ***H01H 9/02*** | (2006.01) |
| *H01H 1/40* | (2006.01) |
| *H01H 21/12* | (2006.01) |
| *H01H 21/28* | (2006.01) |

(52) U.S. Cl.
CPC ..... *H01H 21/24* (2013.01); *H01H 1/40* (2013.01); *H01H 21/12* (2013.01); *H01H 21/28* (2013.01); *H01H 2203/036* (2013.01)

(56) References Cited

U.S. PATENT DOCUMENTS

| | | | | |
|---|---|---|---|---|
| 7,223,931 | B2 * | 5/2007 | Kiyono ..... | H01H 1/36 200/276.1 |
| 2006/0254889 | A1 | 11/2006 | Kiyono et al. | |

FOREIGN PATENT DOCUMENTS

| | | | |
|---|---|---|---|
| JP | 2007-220517 | A | 8/2007 |
| JP | 4062319 | B2 | 3/2008 |

* cited by examiner

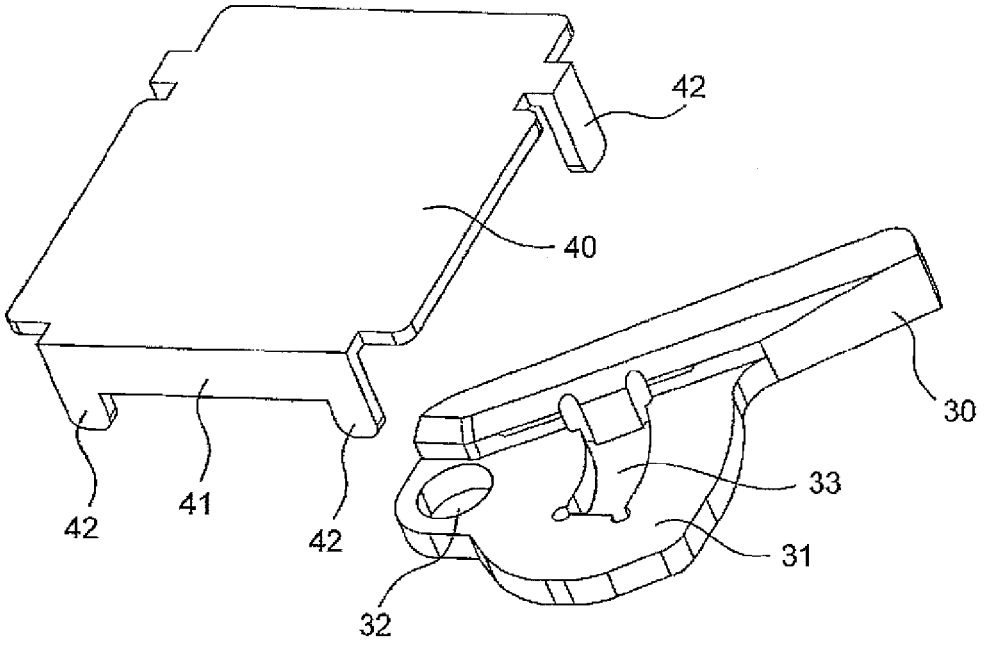
Fig. 2
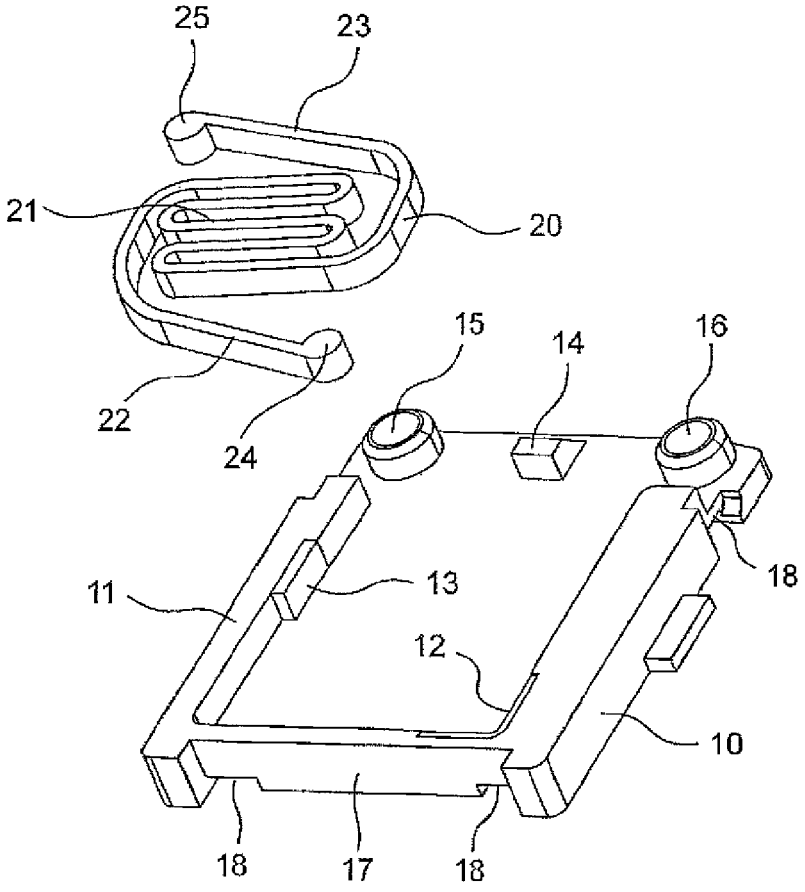

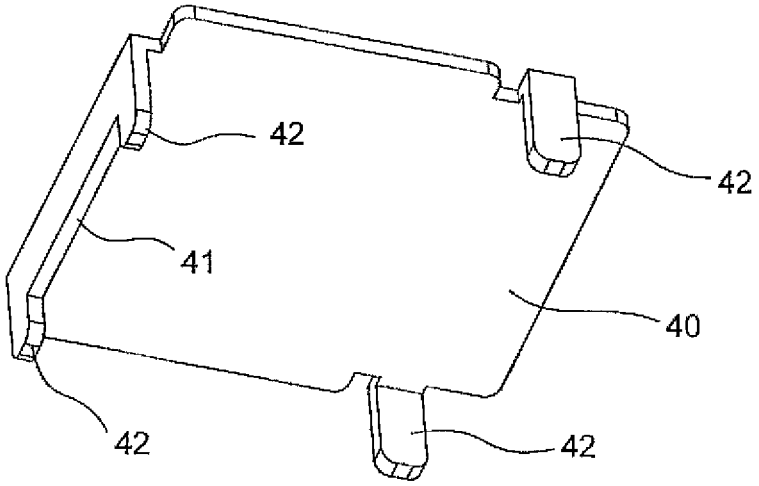
Fig. 3
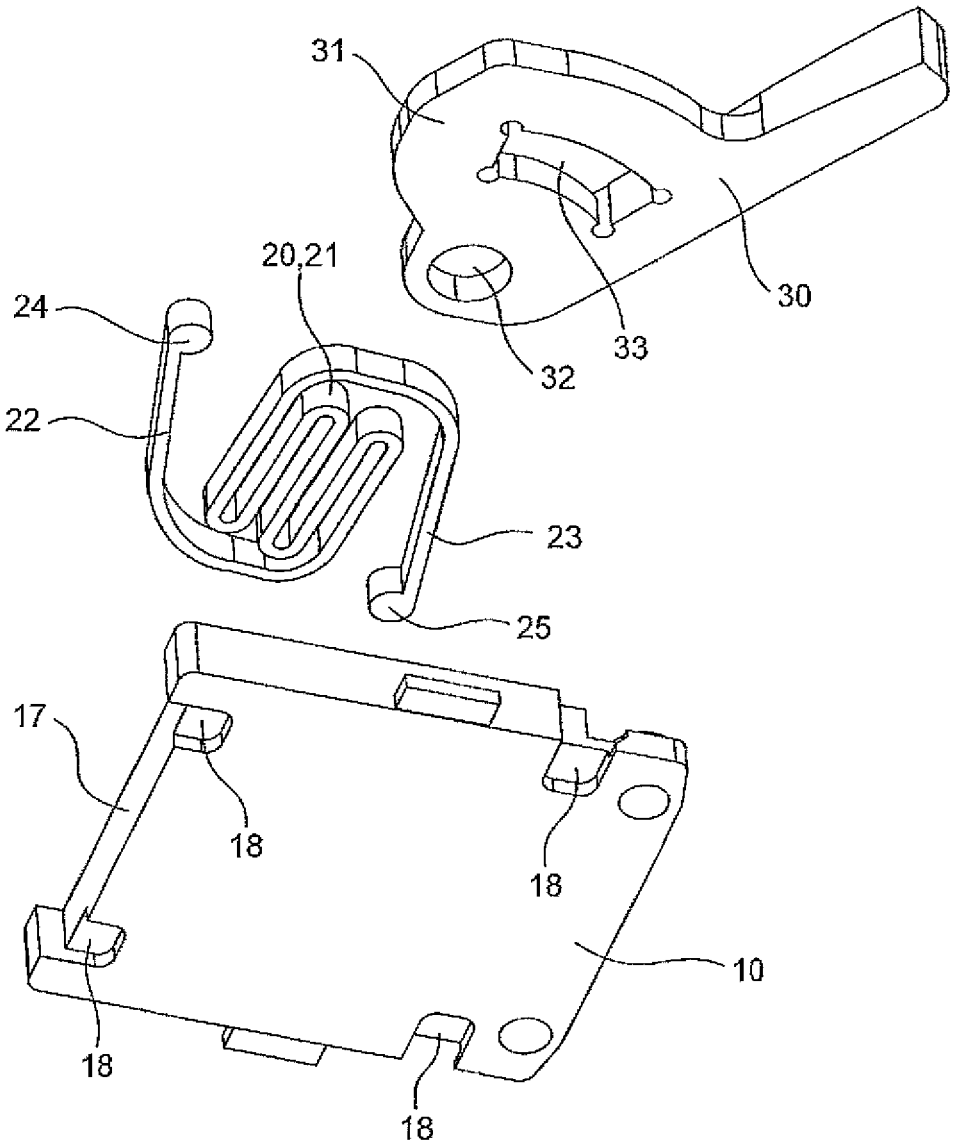

SWITCH

BACKGROUND

1. Technical Field

The present invention relates to a switch. In particular, it relates to a microminiature and thin switch used for electronic devices such as mobile phones, smart phones and digital cameras.

2. Related Art

Conventionally, for example, there is known a switch comprising: a base; a coil spring; a movable contact piece whose one end portion is rotatably supported on the base; an operation lever whose one end portion is rotatably supported on the base and whose driving portion extending from the one end portion presses a coil portion of the movable contact piece; and a cover having a planar shape that can cover the base, and fixed to the base so as to compress the coil portion, wherein the coil portion of the movable contact piece is pressed by the operation lever to give a torsional moment, so that the movable contact piece is rotated with its one end portion as a fulcrum, the coil portion of the movable contact piece slides on at least one fixed contact exposed from a projecting surface projecting from a bottom surface of the base, and the other end portion of the movable contact piece slides on a common fixed contact exposed from an inside surface of the base (refer to Patent Document 1).

Patent Document 1: Japanese Patent No. 4062319

SUMMARY

However, in the above switch, since a contact pressures is secured using a spring force of the coil spring, there was a limit of reduction in height dimension. Further, it was not easy to mass-produce spring members with complicated shapes and high dimensional accuracy by press working. Therefore, it was difficult to obtain a small switch that has a desired stroke and contact pressure.

One or more embodiments of the present invention provides a super-thin switch that has a low height dimension, while securing the desired stroke and contact pressure.

A switch according to one or more embodiments of the present invention comprises: a base in which a frame portion is provided integrally with an outer peripheral portion of an upper surface thereof, a common fixed contact is provided at a corner of inside surfaces of the frame portion, and a fixed contact is provided on an inside surface thereof opposite to the common fixed contact; a spring member in which, of elastic arm portions extending respectively from both ends of a bellows-like spring portion, a free end portion of one elastic arm portion serves as a sliding movable contact, a free end portion of the other elastic arm portion serves as a rotationally movable contact, and the rotationally movable contact is positioned so as to be in contact with the common fixed contact of the base; and an operation lever including an operation rib, which comes in contact with the one elastic arm portion of the spring member, and rotationally supported on the base, wherein the operation lever is rotated, and the one elastic arm portion of the spring member is pushed down by the operation rib, whereby the bellows-like spring portion of the spring member is elastically deformed, and the sliding movable contact is brought into contact with and separated from the fixed contact.

In one or more embodiments of the present invention, unlike the conventional example, since it is not necessary to use a coil spring, a thin switch that has a low height dimension is obtained. Further, since the spring member is formed of the bellows-like spring portion, and the elastic arm portions extending respectively from both the ends thereof, the switch that has the desired stroke and contact pressure is obtained.

In one or more embodiments of the present invention, the bellows-like spring portion of the spring member may be formed so as to be generally parallel to the elastic arm portions. In particular, when the one elastic arm portion of the spring member is pushed down by the operation rib of the operation lever, the bellows-like spring portion of the spring member may be elastically deformed in its extension direction.

Accordingly, the switch that has the desired stroke and contact pressure is obtained.

In one or more embodiments of the present invention, the bellows-like spring portion of the spring member may be formed in a direction crossing the elastic arm portions.

Accordingly, the switch that has the desired stroke and contact pressure is obtained. In particular, since the bellows-like spring member is easily deformed, the switch that has a soft operation feeling is obtained.

In one or more embodiments of the present invention, a reinforcing rib may be integrally formed inside of a curved portion of the bellows-like spring portion.

Accordingly, stress concentration in the curved portion of the bellows-like spring portion can be suppressed, and fatigue failure becomes less likely to occur. Therefore, the switch with a long lifetime is obtained.

In one or more embodiments of the present invention, the curved portion of the bellows-like spring portion may be thicker.

Accordingly, stress concentration in the curved portion of the bellows-like spring portion can be suppressed, and fatigue failure becomes less likely to occur. Therefore, there is an effect that the switch with a long lifetime is obtained.

BRIEF DESCRIPTION OF THE DRAWINGS

FIG. 2 is an exploded perspective view of the switch shown in FIG. 1;

FIG. 3 is an exploded perspective view of the switch of FIG. 1, which is viewed from a different angle;

DETAILED DESCRIPTION

Figure 1A:
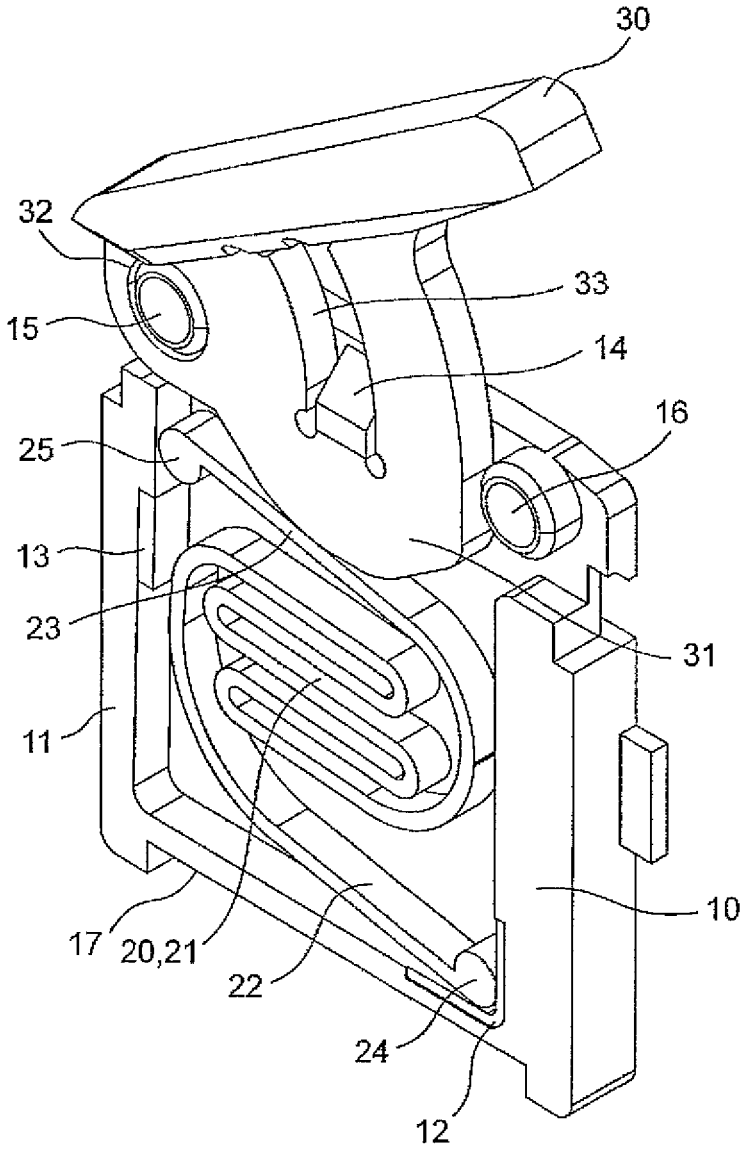
FIG. 1(A) and FIG. 1(B) are a perspective view and a side view, respectively, of a switch according to a first embodiment of the present invention.
Figure 1B:
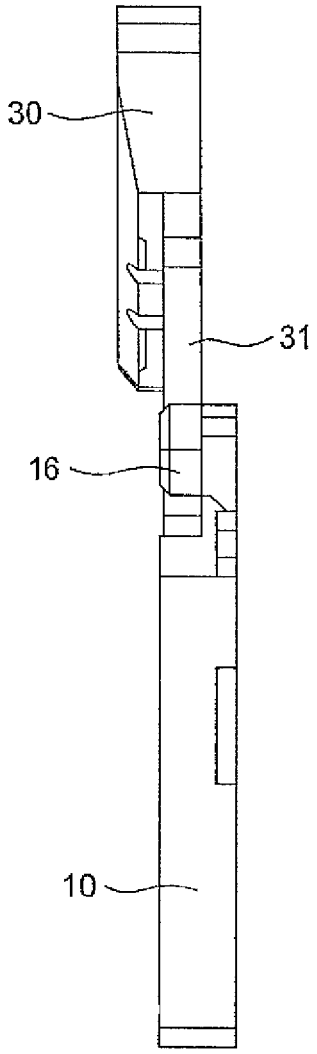

Embodiments of the present invention will be described with reference to the attached drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

As shown in FIG. 1(A) through FIG. 4(B), a switch according to a first embodiment comprises a base 10, a spring member 20, an operation lever 30, and a cover 40. For the sake of convenience of explanation, the cover 40 is not illustrated in FIGS. 1(A)-(B) and FIGS. 4(A)-(B).

As shown in FIG. 2, the base 10 is obtained by forming a roughly U-shaped frame portion 11 integrally with an outer peripheral portion of a roughly rectangular surface of the base 10. A common fixed contact 12 is provided at a corner of inside surfaces of the frame portion 11, while a fixed contact 13 is provided on an inside surface of the frame portion 11, which is located obliquely across from the common fixed contact 12. An outer peripheral portion not provided with the frame portion 11 is provided with a guiding projection 14 projecting therefrom. A rotational shaft 15 and a position restricting projection 16 are protrusively provided with the guiding projection 14 being interposed between them. Further, in the base 10, a central portion of an outside surface of the frame portion 11 is provided with a positioning notch portion 17, and engaging recesses 18 are provided along the outer peripheral portion of a bottom surface thereof.

The spring member 20, which is produced by an electrocasting method, has conductivity. Elastic arm portions 22, 23 extend from both ends of a bellows-like spring portion 21, and their tip portions serve respectively as a rotationally movable contact 24 and a sliding movable contact 25. In particular, the bellows-like spring portion 21 is formed so as to be generally parallel to the elastic arm portions 22, 23. By housing the spring member 20 within the frame portion 11 of the base 10, in a free state, the rotationally movable contact 24 is in contact with the common fixed contact 12, while the sliding movable contact 25 is placed so as to be brought into sliding contact with the inside surface of the frame portion 11 (FIGS. 4(A)-(B)).

One end of an extended operation rib 31 of the operation lever 30 is provided with a shaft hole 32 which is fitted over the rotational shaft 15, and an intermediate region of the extended operation rib 31 is provided with a guiding groove 33 which is fitted with the guiding projection 14. The shaft hole 32 of the operation lever 30 is fitted over the rotational shaft 15 of the base 10, and the guiding groove 33 is fitted with the guiding projection 14 of the base 10, so that the operation lever 30 is rotatably supported.

As shown in FIG. 3, the cover 40 has a planar shape that can cover the surface of the base 10. The cover 40 is provided with a folding portion 41 at a position fitted to the notch portion 17 of the base 10, and is provided with engagement pawl portions 42 at positions engageable with the engaging recesses 18 of the base 10. The cover 40 is positioned to the base 10, to which the spring member 20 and the operation lever 30 are assembled, to cover the base 10. The folding portion 41 and the engaging pawl portions 42 of the cover 40 are engaged, respectively, with the notch portion 17 and the engaging recesses 18 of the base 10, whereby the spring member 20 and the operation lever 30 are prevented from falling off.

Next, an operation method of the switch comprising the above component members will be described.

Figure 4A:
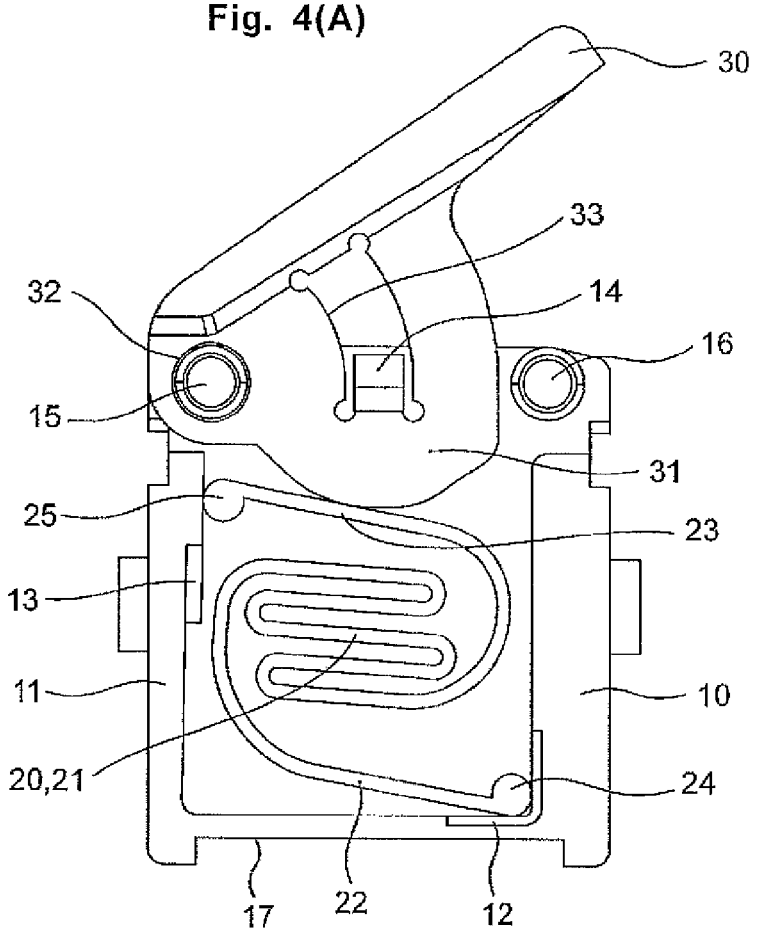
FIG. 4(A) and FIG. 4(B) are front elevational views of the switch of FIG. 1, which show respectively before and after its operation.
Figure 4B:
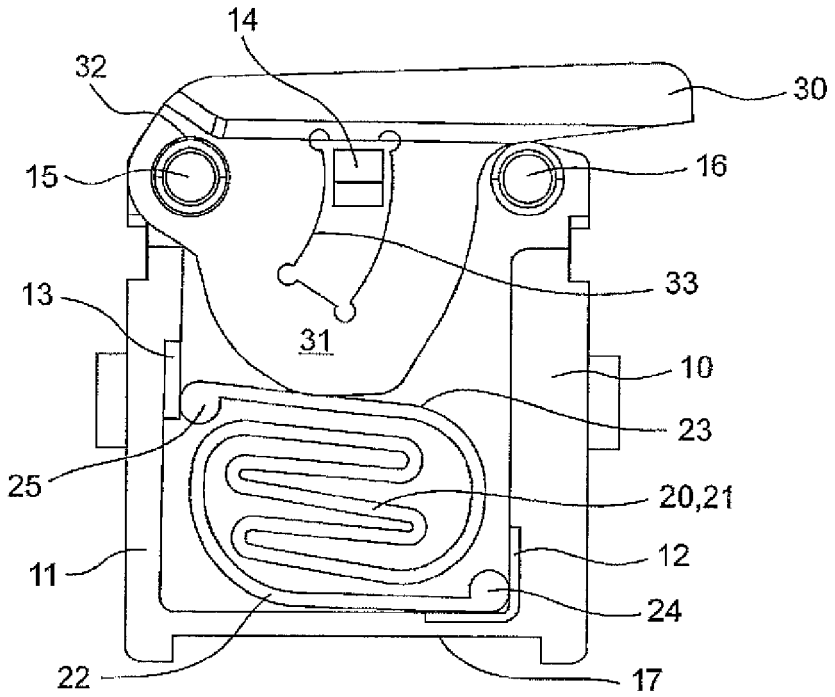

As shown in FIG. 4(A), before operation, the operation rib 31 of the operation lever 30 is only in contact with the elastic arm portion 23 of the spring member 20. Also, the rotationally movable contact 24 of the spring member 20 is in contact with the common fixed contact 12, while the sliding movable contact 25 is only in contact with the inside surface of the frame portion 11, and not in contact with the fixed contact 13.

Then, when a free end portion of the operation lever 30 is pushed down, the operation rib 31 is rotated with the rotation shaft 15 as a fulcrum so as to push down the elastic arm portion 23 of the spring member 20. Therefore, the elastic arm portions 23 and 22 are compressed so as to be elastically deformed, and the bellows-like spring portion 21 is elastically deformed in its extension direction. Further, the sliding movable contact 25 is lowered to be brought into contact with the fixed contact 13, whereby the common fixed contact 12 and the fixed contact 13 are electrically connected through the spring member 20.

Subsequently, when a pressing force with respect to the operation lever 30 is released, the operation rib 31 of the operation lever 30 is pushed up by a spring force of the spring member 20 per se. Therefore, the operation lever 30 is reversely rotated with the rotation shaft 15 as the fulcrum to return to the original position, and the sliding movable contact 25 is separated from the fixed contact 13.

Figure 5A:
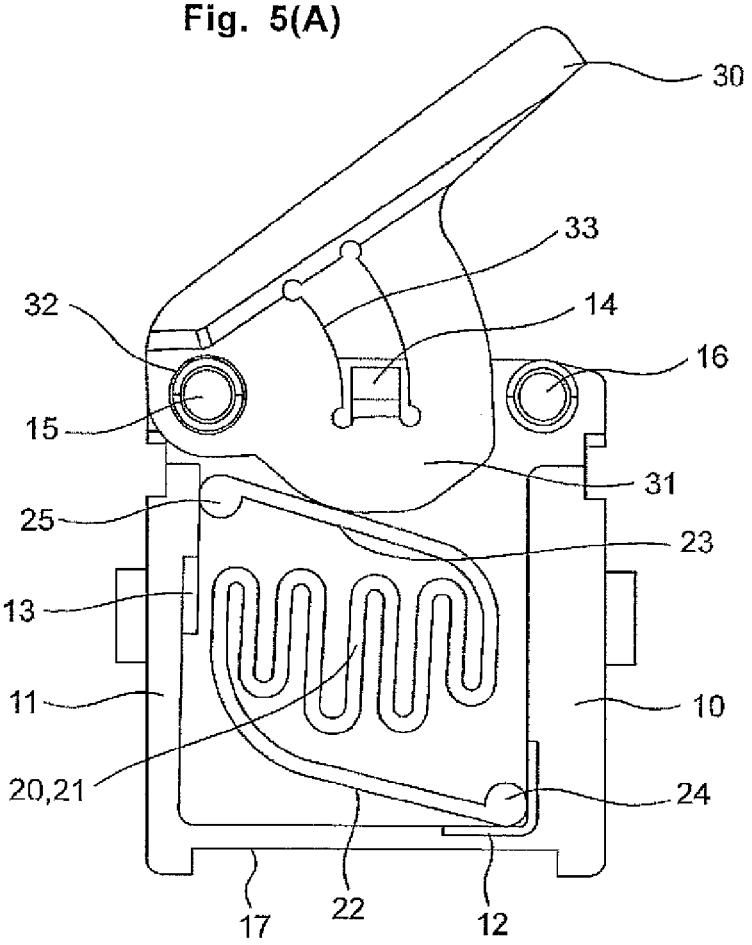
FIG. 5(A) and FIG. 5(B) are front elevational views of a switch according to a second embodiment of the present invention, which show respectively before and after its operation.
Figure 5B:
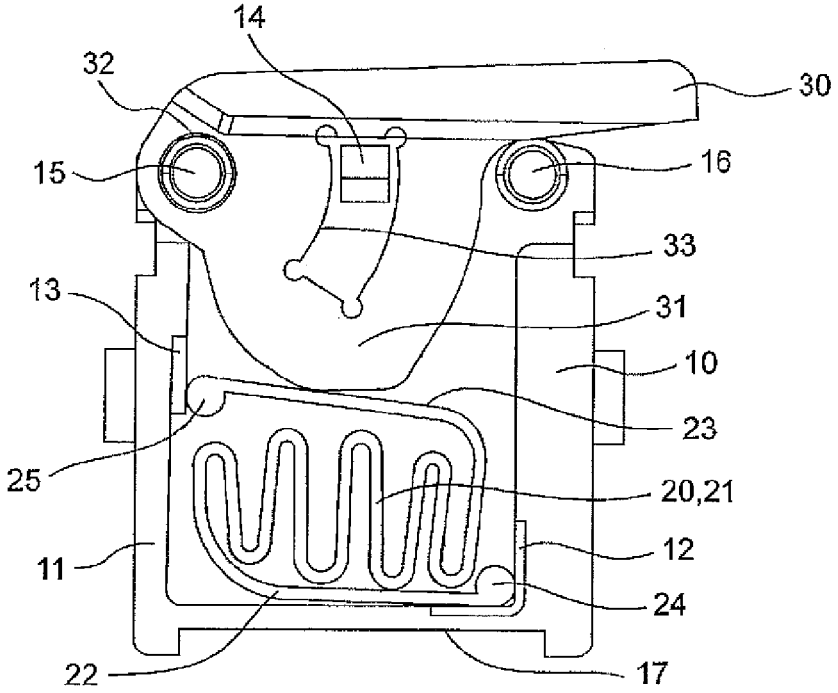

As shown in FIGS. 5(A)-(B), a second embodiment of the present invention is almost the same as the above first embodiment. The difference is that the bellows-like spring portion 21 of the spring member 20 is formed so as to cross the elastic arm portions 22, 23. Since the rest are almost the same as the first embodiment, the same portions are designated by similar numerals, and their explanation will be omitted.

In the switch of the second embodiment, since the bellows-like spring 21 is more easily deformed, there is an advantage that the switch that has a soft operation feeling is obtained.

Figure 6A:
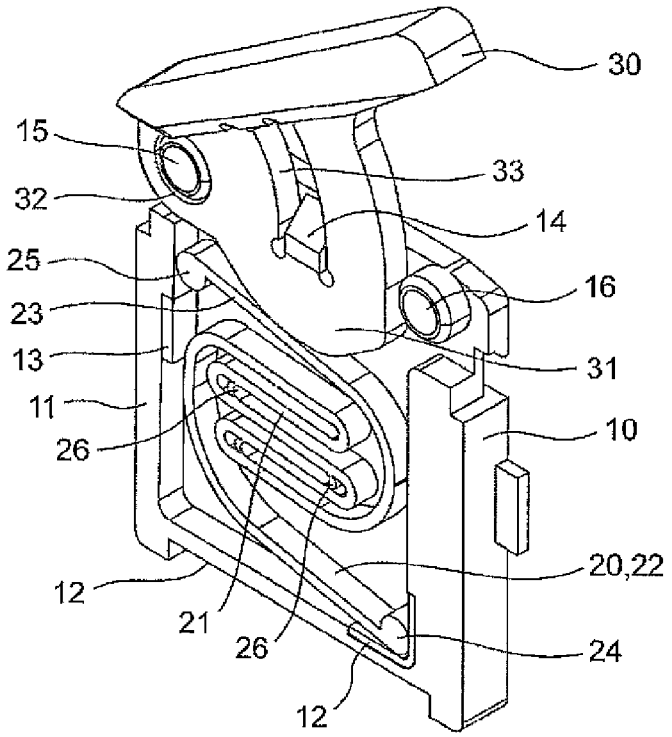
FIG. 6(A) and FIG. 6(B) are a perspective view and a front elevational view, respectively, of a switch according to a third embodiment of the present invention, which show before its operation.
Figure 6B:
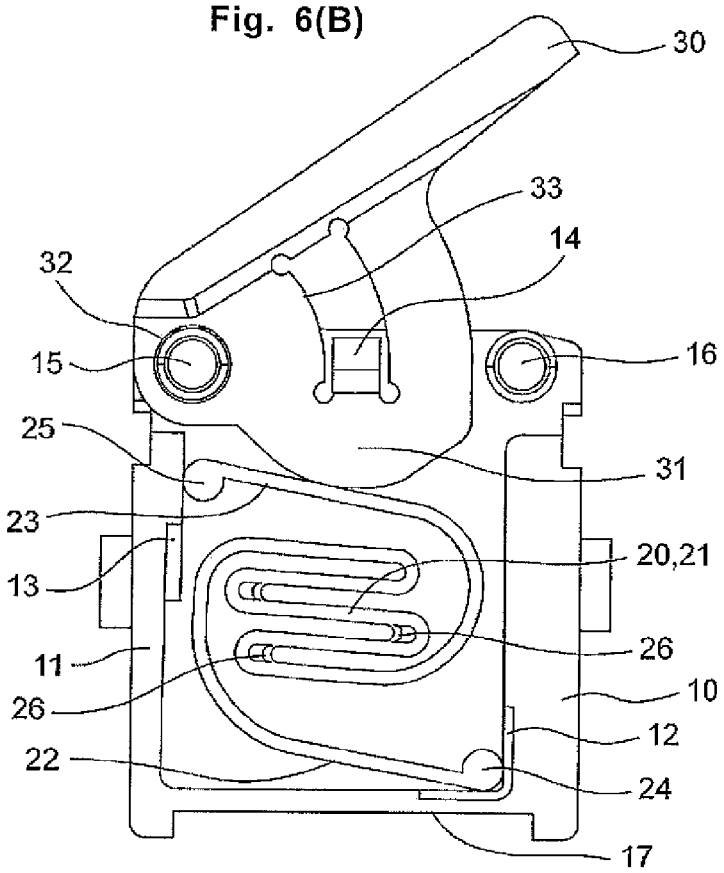

As shown in FIGS. 6(A)-(B), a third embodiment of the present invention is almost the same as the above first embodiment. The difference is that reinforcing ribs 26 are integrally formed inside of curved portions of the bellows-like spring portion 21.

According to the third embodiment, since the reinforcing ribs 26 are provided inside the curved portions of the bellows-like spring portion 21 where stress concentration is liable to occur, fatigue failure due to the stress concentration can be suppressed, and there is an advantage that the switch having a long lifetime is obtained.

Needless to say, only the curved portions of the bellows-like spring portion 21 may be thicker in order to prevent stress concentration at the curved portions.

INDUSTRIAL APPLICABILITY

The switch according to one or more embodiments of the present invention can be applied not only to electronic devices such as mobile phones, but also to other small electronic devices.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

EXPLANATION OF NUMERALS

10: base
11: frame portion
12: common fixed contact
13: fixed contact
14: guiding projection
15: rotational shaft
16: position restricting projection
20: spring member
21: bellows-like spring portion
22, 23: elastic arm portion
24: rotationally movable contact

25: sliding movable contact
30: operation lever
31: operation rib
32: shaft hole
33: guiding groove
40: cover

The invention claimed is:

1. A switch comprising:

a base comprising:

a frame portion disposed integrally with an outer peripheral portion of an upper surface of the base, a common fixed contact disposed at a corner of inside surfaces of the frame portion, and a fixed contact disposed on an inside surface of the base opposite to the common fixed contact;

a spring member comprising:

elastic arm portions extending respectively from both ends of a bellows-shaped spring portion, wherein a free end portion of one of the elastic arm portions serves as a sliding movable contact, wherein a free end portion of another of the elastic arm portions serves as a rotationally movable contact, and wherein the rotationally movable contact is positioned so as to be in contact with the common fixed contact of the base; and an operation lever including an operation rib, which comes in contact with the one elastic arm portion of the spring member, and which is rotationally supported on the base, wherein, when the operation lever is rotated, the one elastic arm portion of the spring member is pushed down by the operation rib, whereby the bellows-shaped spring portion of the spring member is elastically deformed, and the sliding movable contact is brought into contact with and separated from the fixed contact.

2. The switch according to claim 1, wherein the bellows-shaped spring portion of the spring member is formed so as to be generally parallel to the elastic arm portions.

3. The switch according to claim 2, wherein when the one elastic arm portion of the spring member is pushed down by the operation rib of the operation lever, the bellows-shaped spring portion of the spring member is elastically deformed in extension direction thereof.

4. The switch according to claim 1, wherein the bellows-shaped spring portion of the spring member is formed in a direction crossing the elastic arm portions.

5. The switch according to claim 1, wherein a reinforcing rib is integrally formed inside of a curved portion of the bellows-shaped spring portion.

6. The switch according to claim 1, wherein the curved portion of the bellows-shaped spring portion is thicker than other portions of the bellows-shaped spring portion.

7. The switch according to claim 2, wherein a reinforcing rib is integrally formed inside of a curved portion of the bellows-shaped spring portion.

8. The switch according to claim 3, wherein a reinforcing rib is integrally formed inside of a curved portion of the bellows-shaped spring portion.

9. The switch according to claim 4, wherein a reinforcing rib is integrally formed inside of a curved portion of the bellows-shaped spring portion.

10. The switch according to claim 2, wherein the curved portion of the bellows-like spring portion is thicker than other portions of the bellows-shaped spring portion.

11. The switch according to claim 3, wherein the curved portion of the bellows-like spring portion is thicker than other portions of the bellows-shaped spring portion.

12. The switch according to claim 4, wherein the curved portion of the bellows-like spring portion is thicker than other portions of the bellows-shaped spring portion.

13. The switch according to claim 5, wherein the curved portion of the bellows-like spring portion is thicker than other portions of the bellows-shaped spring portion.

* * * * *